US005504495A

United States Patent [19]

Bendov

[11] Patent Number: 5,504,495

[45] Date of Patent: Apr. 2, 1996

[54] FIELD CONVERTIBLE NTSC/HDTV BROADCAST ANTENNAS

[75] Inventor: Oded Bendov, Cherry Hill, N.J.

[73] Assignee: General Signal Corporation, Stamford, Conn.

[21] Appl. No.: 122,180

[22] Filed: Sep. 17, 1993

Related U.S. Application Data

[63] Continuation of Ser. No. 723,390, Jun. 28, 1991, abandoned.

[51] Int. Cl.[6] ..... H01Q 21/28

[52] U.S. Cl. ..... 343/724; 343/853; 343/876; 343/891; 343/895; 343/725

[58] Field of Search ..... 343/725, 729, 343/799, 797, 798, 890, 891, 853, 876, 724, 770, 895; H01Q 21/00, 21/28, 21/30, 1/36

[56] References Cited

U.S. PATENT DOCUMENTS

| | | | |
|---|---|---|---|
| 2,127,336 | 8/1938 | Leng | 343/876 |
| 2,149,333 | 3/1939 | Brown | 343/798 |
| 2,496,242 | 1/1950 | Bradley | 343/853 |
| 2,771,606 | 11/1956 | Kandoian | 343/890 |
| 2,867,804 | 1/1959 | Gihring | 343/853 |
| 4,011,567 | 3/1977 | Ben-Dov | 343/853 |

*Primary Examiner*—Michael C. Wimer
*Attorney, Agent, or Firm*—Ohlandt, Greeley, Ruggiero & Perle

[57] ABSTRACT

A convertible antenna system for enabling immediate installation of an antenna for continuing the broadcasting of conventional signals in the currently available channel ranges, but which allows for eventual convertibility to HDTV (high definition television) operation. Thus, field convertibility adjustments or modifications are made to the initially installed system after the point in time at which a channel has been assigned for HDTV broadcasting. Such channel assignment is in one of a number of possible frequency spectrum locations such as a channel adjacent to the conventional broadcast channel, or a significantly removed VHF channel, or even a UHF channel. The field adjustments can simply involve coupling or decoupling lines and associated components, or can include replacing an antenna portion.

9 Claims, 5 Drawing Sheets

FIG.1A
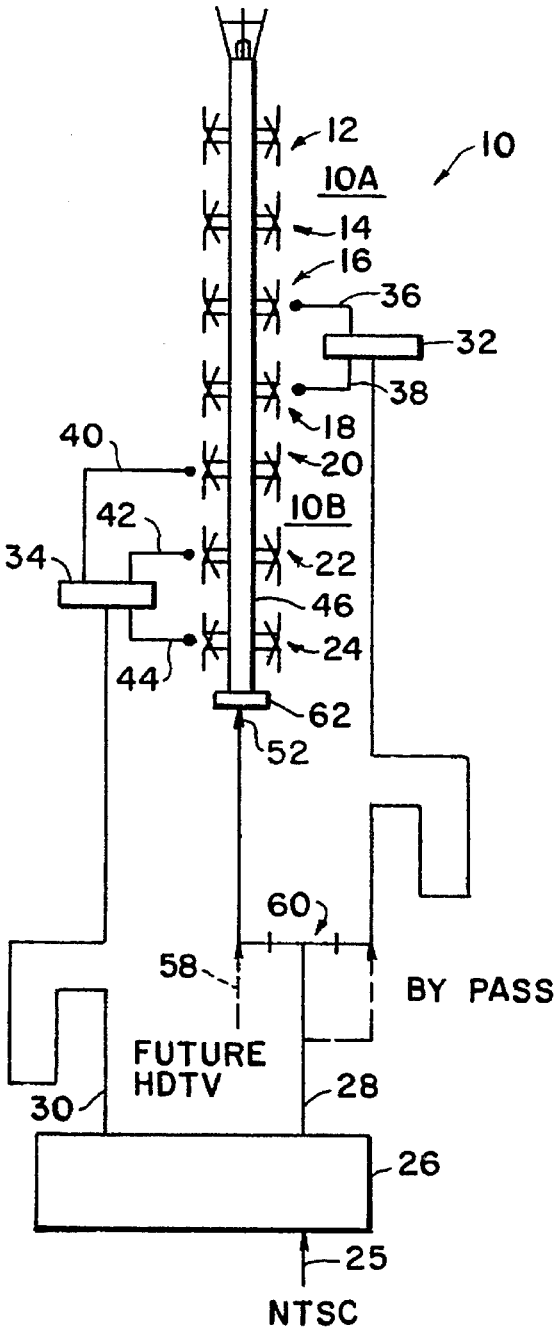
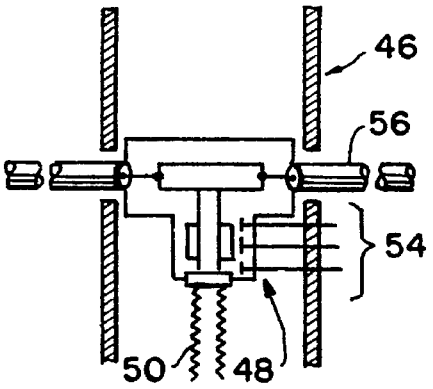
FIG.1B

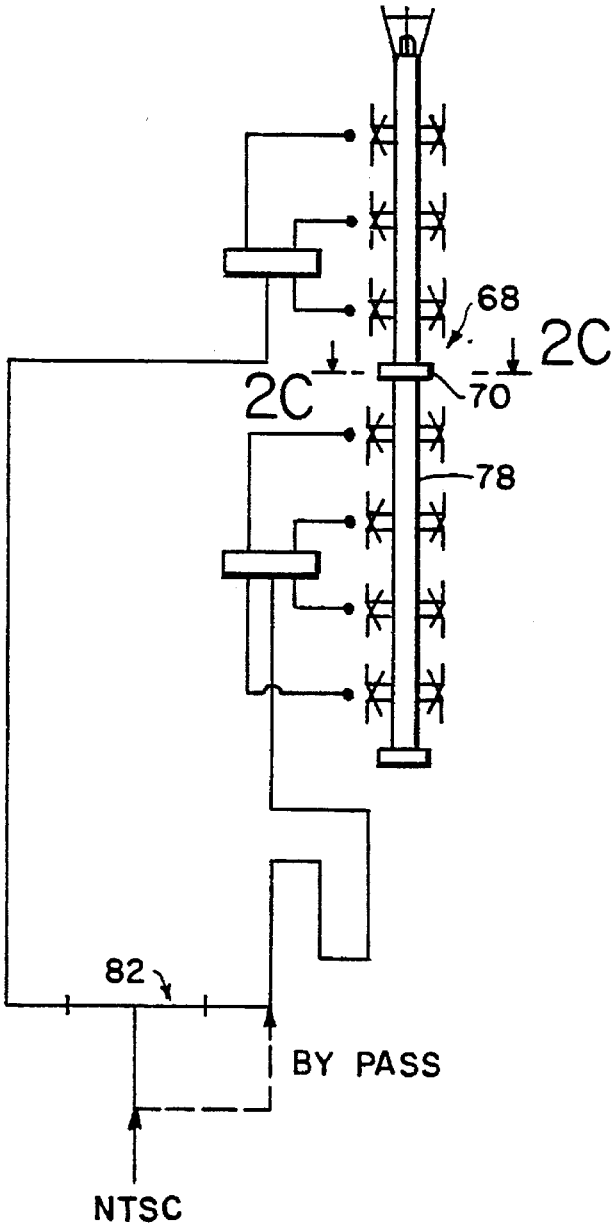
FIG.2A
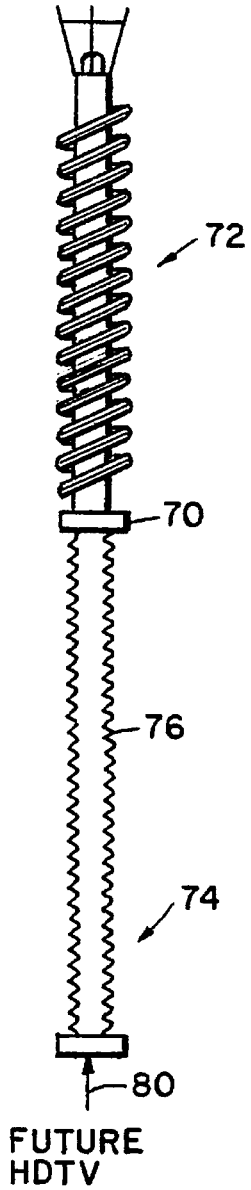
FIG.2B
FIG.2C
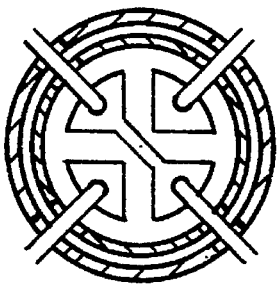

FIELD CONVERTIBLE NTSC/HDTV BROADCAST ANTENNAS

This is a continuation of application Ser. No. 07/723,390, filed on Jun. 28, 1991, now abandoned.

BACKGROUND OF THE INVENTION

The present invention relates to an antenna system and more particularly to a system that provides convertibility, that is to say, that enables the initial installation of a conventional or NTSC antenna which is "field convertible" into two separate antennas to allow for HDTV transmission at some future date.

Many years have elapsed since the concept of high definition television (HDTV) was first introduced. The well-known advantage to this form of television is that significantly improved picture quality and sound are expected. However, there has been a great reluctance on the part of broadcasters to take any initiatives in bringing high definition television into common use, chiefly for the reason that the government (FCC) must first approve the transmission standards. Further, they are in the dark as to what channels may be assigned to,them for high definition television broadcasting.

Accordingly, generally stated, within the broadcast community the problems concerning how to build and where to install a new HDTV broadcast antenna have necessarily been deferred. However, solutions to the aforementioned problems must be reached. In other words, that "bridge" must be crossed now.

The present invention recognizes that structural and picture quality requirements for broadcasting point to one solution. Such solution requires a low gain antenna for the transmission of the HDTV signals, whereby the lower gain (and hence shorter length) HDTV antenna and the conventional or NTSC antenna can be integrated into one unit for direct replacement on existing towers with little or no reinforcement required for the towers.

It has been found that if this solution of a relatively low-gain HDTV antenna integrated with a conventional antenna is not adopted, the alternative approaches will involve mechanically impractical and—from a picture quality standpoint— undesirable solutions, involving very large increases in tower loading for such stack configurations. In other words, a new tower would be required to handle the greater loading.

SUMMARY OF THE INVENTION

Accordingly, it is a primary object of the present invention to provide a convertible antenna system whereby the separate antennas or antenna portions are field convertible in the sense that the design includes all the necessary hardware to convert when desired from an initially installed NTSC antenna to an NTSC/HDTV stacked system for broadcasting both types of signals.

Because the HDTV portion is designed such that the conversion involves a low-gain antenna which is being "integrated", the stack is wind load compatible with NTSC antennas and therefore only minor, if any, tower reinforcement will be required.

In addition to the aforestated benefits, it must be emphasized that no prior knowledge of the assigned HDTV channel is required. As a result, products in accordance with the present invention can be sold long before the FCC adopts any new standards involving assignments of HDTV frequencies.

It should be noted that the effective radiated power (ERP) loss to the NTSC channel after conversion has been effected is relatively low and is not expected to exceed −2 db in most cases. In the typical examples explained herein, it is only −0.3 db.

It should also be noted that, although the examples hereinafter make certain assumptions about particular channels for NTSC and sometimes involve UHF frequencies for HDTV, it will be appreciated that the convertible antenna concept of the present invention is not restricted to any particular channel combination.

Briefly stated, the primary feature of the present invention is defined as the following combination: a convertible antenna system for broadcasting conventional signals alone and, when field converted, both conventional and HDTV signals, comprising: a first antenna section for broadcasting said conventional signals; a second antenna section for eventually broadcasting said HDTV signals, the ERP or effective radiative power, of said HDTV signals being between −6 db and −12 db with respect to said conventional signals; means for selectively coupling said second antenna section to said first antenna section such that said first antenna section is initially operable for broadcasting the conventional signals, and, when alternately mechanically coupled together but electrically decoupled, said first and second antenna sections independently broadcast the respective conventional and HDTV signals.

It will be appreciated as the description proceeds that in accordance with several of the embodiments of the present invention, the antenna section for broadcasting the HDTV signals is a replacement section, that is to say, the antenna, which is used for broadcasting the conventional signals, has an initial second section for conventional broadcasting which is constructed to be removable, such that the replacement second antenna section serves only for HDTV broadcasting. However, in the case of the first embodiment to be described, both the first and second antenna sections are utilized together, i.e., they are coupled mechanically and electrically in the initial installation so that they both serve to broadcast the conventional signals; then, when the time comes to convert, a junction box which feeds the upper portion has its installed dipoles modified for the new frequencies, that is, the HDTV frequencies; and further, a suitable alternate connection is made to the junction box by means of a flex or rigid line from the source of HDTV signal. Accordingly, only a few simple adjustments are required to convert to HDTV broadcasting and, in this first embodiment, no antenna replacement is required. This happens to be the case because in such embodiment both the NTSC signals or conventional signals and the HDTV signals are in closely adjacent channels so that only the aforenoted electrical coupling adjustments are needed.

A subordinate feature of the present invention resides in the several junction box arrangements that are provided in order to enable ready convertibility.

Another feature resides in the provision, in a particular embodiment, that the antenna system includes an 8 helices mode 2 type of operation, involving NTSC segments in the lower section. This configuration is similar to the already known antenna scheme of U.S. Pat. No. 3,940,772. The HDTV signals involved are in either the UHF band or in an adjacent NTSC channel. The fourth embodiment to be described herein involves this type of configuration.

Other and further objects, advantages and features of the present invention will be understood by reference to the following specification in conjunction with the annexed drawing, wherein like parts have been given like numbers.

BRIEF DESCRIPTION OF THE DRAWING

FIG. 1A is an elevational schematic view of an antenna system in accordance with a first embodiment of the present invention designated case 1; i.e., for the situation in which the broadcasting station currently operates on one of channels 2 through 6 and a closely adjacent channel has been assigned for the HDTV operation;

FIG. 1B is a cross-sectional view of a portion of the antenna system of FIG. 1A, particularly illustrating an arrangement including a junction box located inside the pole of the antenna system, between the two top levels or bays of the system, such box connecting from a line to the radiators of those bays to enable broadcasting of conventional signals in the originally installed antenna for NSTC operation, and for broadcasting HDTV signals as a result of field conversion;

FIG. 2A is an elevational schematic view of a second embodiment of an antenna system designated case 2, i.e., for the case in which the NTSC originally-installed antenna is operating in the range of channels 2–6, and then the system is converted in the field to include operation of an HDTV antenna in the channel 7–13 range, such operation involving a 4 helices mode 2 configuration for the HDTV antenna section and with a junction box contained in a suitable flange interface installed as part of the antenna system.

FIG. 2B is an elevation view of an alternate replacement (second) section for the antenna system of FIG. 2A, such section serving to replace the initial second section in the original NTSC installation.

FIG. 2C is a cross-sectional view showing a quadra-pole Balun for feeding the replacement antenna section.

DESCRIPTION OF PREFERRED EMBODIMENTS

Figure 3A:
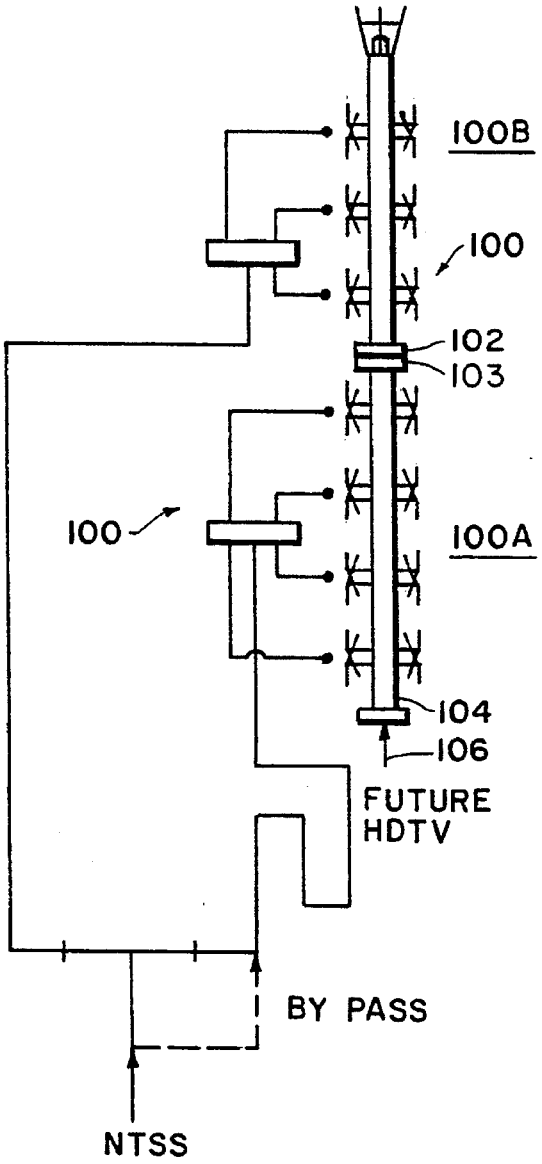
FIG. 3A is an elevational schematic view of another embodiment of an antenna system, designated case 3, i.e., for the case in which the NTSC originally-installed antenna is operating in the range for channels 2–6 and then the system is converted in the field to include operation of an HDTV antenna in the UHF range, the replacement section involving either an eight helices mode 4 configuration, or a slotted, center fed, configuration; and with a junction box contained in a flange interface installed as part of the antenna system.

Referring now to the figures of the drawing and in particular, for the moment, to FIGS. 1A and 1B, there is illustrated a first embodiment (case 1) in accordance with the present invention. There will be seen in these figures an antenna system 10 which is intended to be installed as an original installation for the purpose of broadcasting conventional or NTSC signals for an interim period, and then to be converted for additionally broadcasting HDTV signals. Initially, all of the seven levels or bays 12, 14, 16, 18, 20, 22, and 24 of the antenna system 10 are devoted to transmitting such conventional signals from each group of three radiators 11 located at each of the levels or bays 12–24. The upper portion 10A, including the two bays or levels 12 and 14, is denominated a "second antenna section" because these bays will subsequently be converted to HDTV operation. The lower portion 10B, comprising five bays, is a "first antenna section", serving always for broadcasting NTSC signals.

It will be understood that in the schematic diagram of FIG. 1A only two of the three radiators 11 can be seen at each bay since they are disposed 120 degrees apart, making the third one not viewable in FIG. 1A.

The conventional or NTSC signals are seen to come from a source 25 fed to a 3 db hybrid coupler 26 and thence, by way of the lines 28 and 30, (first transmission line) to respective junction boxes 32 (having 6 ports), and 34 (having 9 ports). The signals are transmitted by means of the flex lines 36 and 38 from junction box 32, and by means of flex lines 40, 42, and 44 from junction box 34. As indicated schematically, the flex lines 36 and 38 feed a group of three equally spaced radiators 11 (rear radiator not seen) in each of the respective bays 16 and 18; whereas each of lines 40, 42, and 44 feed a group of three radiators in the respective bays 20, 22, and 24 respectively.

Referring now to FIG. 1B, it will be appreciated that a pole 46 forms part of the antenna system and that within the pole there is located— between the two top bays 12 and 14—junction box 48 fed by a flexible or rigid line 50 (second transmission line) which extends upwardly through the pole 46 as indicated by the arrow 52 at the bottom of the pole. The flex lines 56 extend through pole 46 for connection to the radiators 11 in upper bays 12 and 14.

Tuners 54 are included as part of the junction box 48 so that the radiators 11 in the upper two bays 12 and 14, that is, the two groups of three, or a total of six radiators, can be fine-tuned in the field as part of the conversion process.

It will be understood that the junction box arrangement just described is designed to operate in a first mode, i.e., as part of the initial operation where only conventional signals are involved. Thus, the conventional signals are fed by the flexible line 50 inside the pole 46 at the time when only NTSC signals are being broadcast. However, when the system is to be field converted, that is, HDTV signals are to be broadcast, the only requirement is that the HDTV input, as seen in FIG. 1A at the bottom of the figure, indicated by arrow 58, be suitably changed, by manipulation of switching Tee 60, so that the HDTV signals are fed to the six radiators in the two bays 12 and 14 by way of the junction box 48, suitable retuning of the tuners 54 being effected to take care of this changed situation.

It will further be understood that since the upper two bays of radiators have now become dedicated to HDTV broadcast, there are only five bays, each having three radiators, now devoted to NTSC signals. This is adjusted for by increasing the power fed to the NTSC section remaining.

Another case or situation that might exist is where the TV broadcasting station is currently on one of channels 2–6 and it turns out that the HDTV broadcasting is assigned to one of channels 7–13 (case 2). It will be understood that a different number of the top bays, such as three bays (see FIG. 2A), can be made removable by means of a flange interface 68, such interface consisting of mating flanges 70. Contained within this interface would be a built-in four-way junction box.

As noted previously, the second antenna section 72 is a replacement involving a 4 helices mode 2 configuration for the HDTV broadcasting. Therefore, as seen in FIG. 2B, the whole replacement therein includes the section 72 in a helical configuration and the lower portion 74, the latter including a flex line 76 for transmitting the HDTV signals, such flex line being contained within the interior of pole 78 seen in FIG. 2A as part of the initial installation.

As noted previously, suitable switching is performed such that, as shown by the arrow 80, a source of future HDTV signals is coupled to the line 76 and at the same time, by reason of the tee switch 82, the three upper bays in FIG. 2A will then be cut out and only the lower four bays will receive the NTSC signals.

Figure 3B:
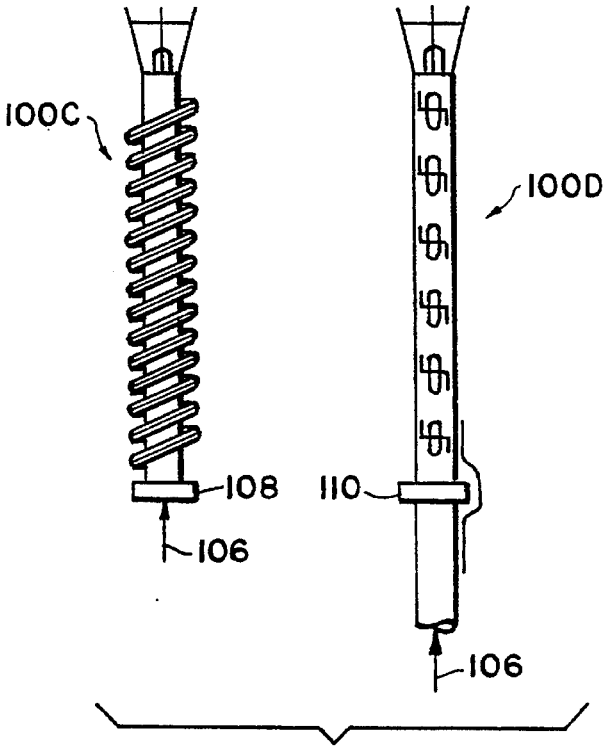
FIG. 3B is an elevation view of the alternate replacement ("second") sections for the antenna system of FIG. 3A, such sections serving to replace the initial second section in the original NTSC installation.

Turning now to FIGS. 3A and 3B, this is a similar case to case 2, but here the broadcasting station is currently operating in the channel 2–6 range, whereas HDTV broadcasting has been assigned to be operative in the UHF range. In such case, several possibilities present themselves.

Referring first to FIG. 3A, there will be seen an antenna system similar to FIG. 2A, but involving a replacement antenna section for the purpose of providing HDTV broadcasting. FIG. 3A shows the antenna system before conversion, that is just the way it is set up to broadcast NTSC signals in the VHF region, the antenna system 100 comprising two portions or segments 100A and 100B.

It should be particularly noted that here the lower antenna portion 100A (first section) has a flange 103 at its upper end, such flange being adapted to mate with a flange 102 at the bottom of upper antenna portion (second section) 100B to provide an interface. The antenna portions are removably attached by bolts or other securing means that can be readily manipulated. This is for the reason that replacement antenna sections 100C and 100D are utilized in this embodiment on an alternate basis, that is to say, it is optional on the part of the operator to use either of these sections, which are both designed for high definition operation in the UHF range, the difference being that portion 100C is in an eight helices, mode four configuration. The choice between the two UHF versions, i.e., 100C or 100D, will depend on several factors, namely (1) transfer function (2) Deicing/Radome requirements and (3) directional pattern requirements.

As before, the HDTV signals are fed through the pole 104 as indicated by arrow 106.

Although two possible UHF antennas are shown, the slot antenna 100D is preferable for two reasons, (a) it could be made directional and (b) it could be center fed, thereby eliminating the inherent beam steering of the helical antenna. The slot design may be bandwidth limited. In that case, some broadbanding, perhaps with the use of a horizontal or vertical dipole over the slot, may be necessary.

Figure 4A:
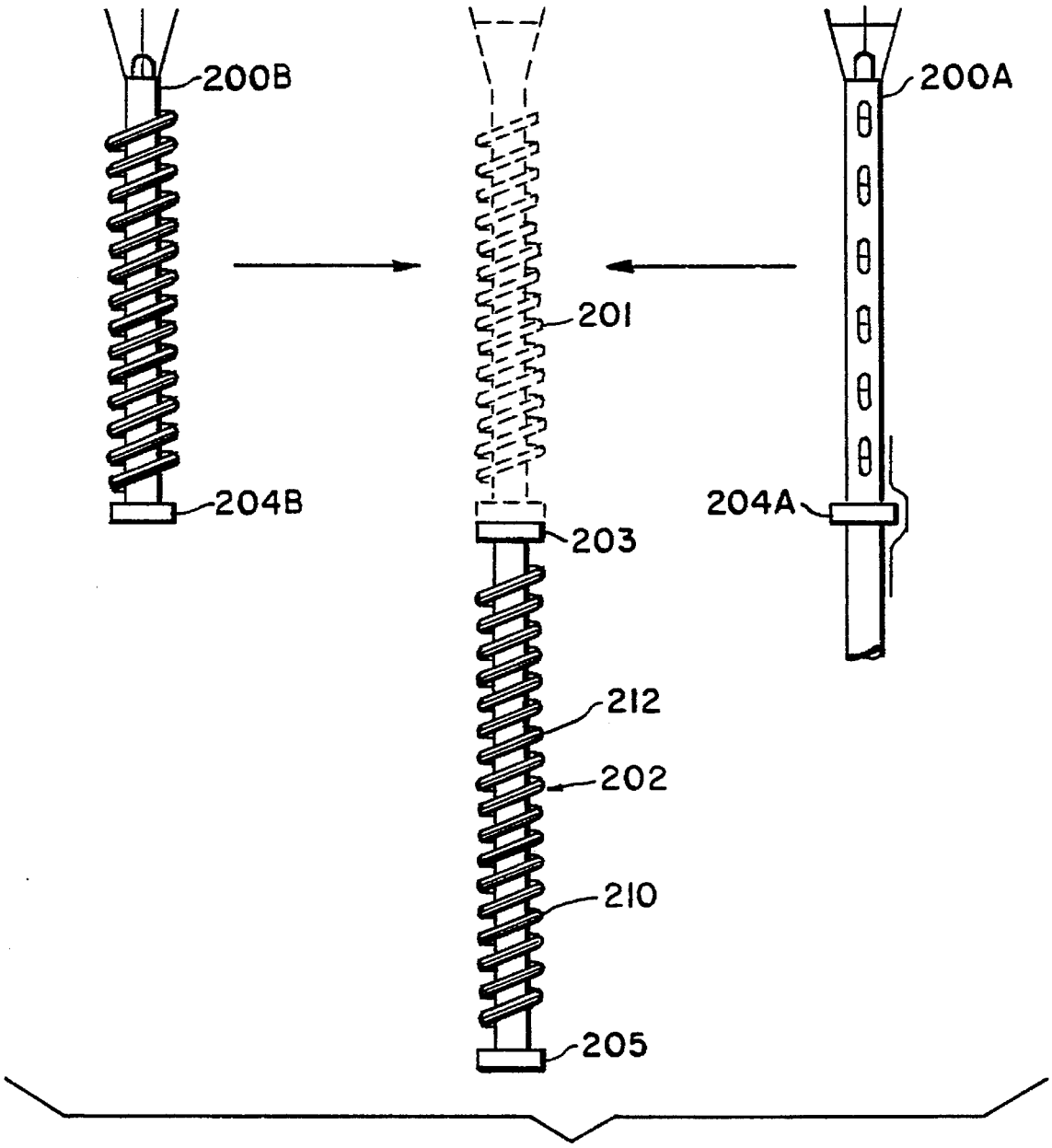
FIG. 4A is an elevation view of the antenna system, particularly illustrating the several alternate HDTV sections that can be incorporated with an NTSC antenna section.
Figure 4B:
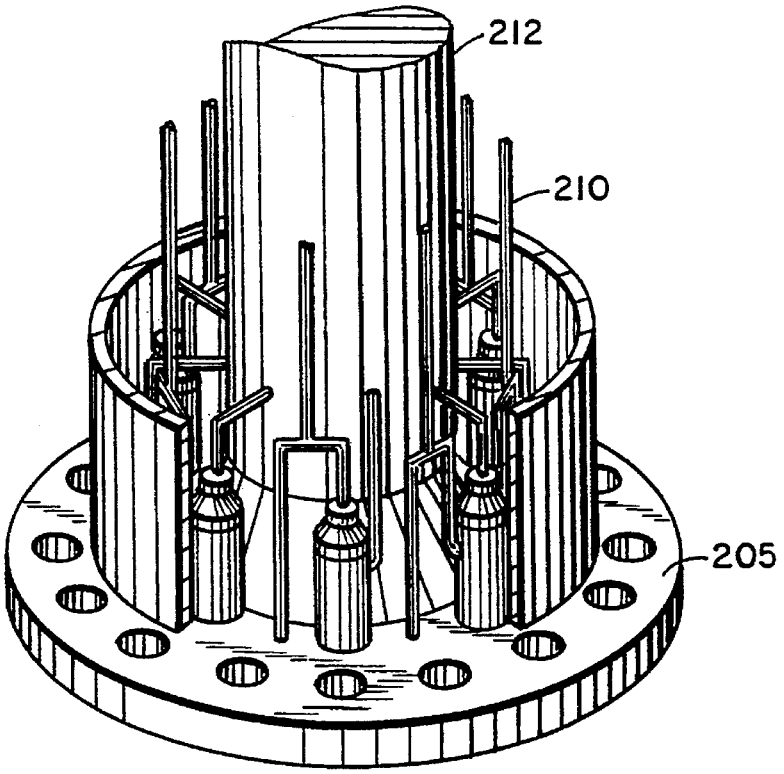
FIG. 4B is a perspective view of the bottom flange member, particularly illustrating in fragmentary form the eight helical conductors extending from the bottom flange and extending about the pole or mast of the antenna system.
Figure 4C:
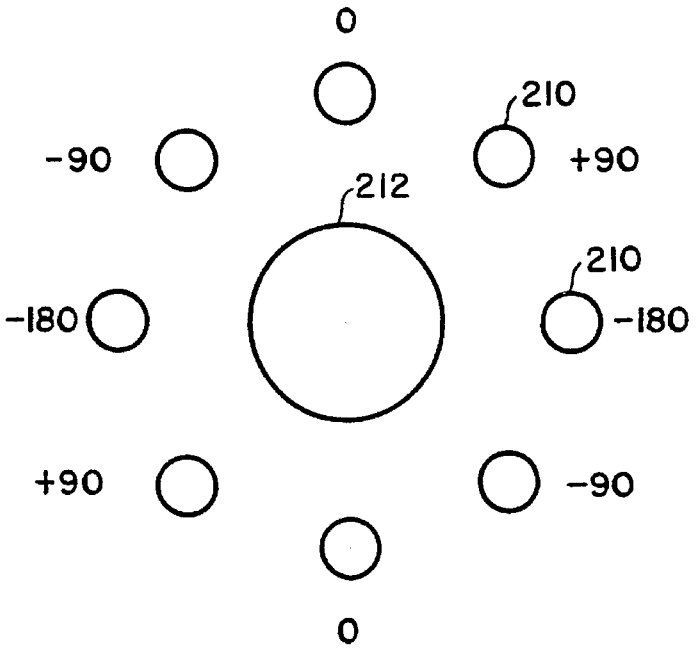
FIG. 4C is a schematic diagram looking from the bottom of the bottom flange in FIG. 4B and particularly illustrating the helices feed phase arrangement at that bottom flange.

Referring now to FIGS. 4A–4C, there is illustrated a fourth embodiment of the present invention. Such embodiment involves a unique eight helices mode 2 configuration for the lower antenna section 202, which, before field conversion is coupled with upper section 201 (FIG. 4A).

In the above-noted figure, it will be seen that when field conversion is to be effectuated, alternate replacement for HDTV may be selected. Thus, in the event that the HDTV is to be in the UHF range, the replacement section 200A would be mated with the lower section 202. However, in the event that HDTV is to be operable in the channels 7–13 range, then the replacement antenna section 200B would be physically connected to the lower section 202; in which event, as indicated previously, a suitable interface involving appropriate junction box connections would be provided by means of the flanges 204A in the case of antenna section 200A and 204B in the case of antenna section 200B, such flanges alternately mating with flange 203 on the lower antenna section 202 such that a suitable interface is provided. Also included with the lower section is a bottom flange 205. This same bottom flange is shown in enlarged form in FIG. 4B, and eight helical conductors 210 are seen extending from that bottom flange so as to encircle in a helical fashion the mast or pole 212.

Referring now to FIG. 4C, there is here shown a schematic diagram of the feed arrangement, particularly depicting the electrical phase relationship among the helical conductors 210. It will be appreciated that a total of two wave lengths are involved and that the total electrical degrees involved in a complete rotation is two times 360 or 720 degrees. Similarly to the four helices configuration of U.S. Pat. No. 3,940,772 assigned to the assignee of the present invention, four of the helical conductors 210, which are wound in a 90 degree of arc spacing about the pole or mast 212, have a relationship of 0, −180, 0, −180. However, the unique aspect of the present invention is that alternately interleaved or interlaced with these four conductors are four additional conductors which have their phases shifted 90 degrees relative to the first set of four conductors. Thus, the interlaced conductors between those having phase 0 and phase −180 have a phase of either +90 or −90 (FIG. 4C). It will be seen in FIG. 4C that adjacent conductors are physically spaced apart by 45°.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

What is claimed is:

1. A convertible antenna system for broadcasting conventional signals alone, and when field converted, both conventional and HDTV signals, comprising:

first and second contiguous antenna sections forming a common antenna structure;

said first antenna section being operable for broadcasting said conventional signals;

said second antenna section being operable for initially broadcasting said conventional signals while said first antenna section is simultaneously broadcasting said conventional signals, and, alternately, for broadcasting said HDTV signals, the ERP or effective radiated power of said HDTV signals being between minus 6 db to minus 12 db with respect to conventional signals;

means for selectively coupling said second antenna section to said first antenna section in a first state and in a second state, said means for selectively coupling including separate sources of conventional and HDTV signals, and first and second transmission lines for transmitting said conventional and HDTV signals respectively;

said first state being a state in which both of the first and second antenna sections are mechanically coupled together, and are electrically coupled together such that both of said sections operate simultaneously to broadcast the conventional signals, said second state being a state in which said first and second antenna sections are mechanically coupled together but electrically de-coupled such that said sections operate totally independently to broadcast exclusively the respective conventional and HDTV signals;

switching means for connecting either said source of conventional signals or said source of HDTV signals to said second transmission line, while constantly connecting only said source of conventional signals to said first transmission line, thereby to provide said first and second states;

said system having an initial second antenna section and an alternate second section, and in which the conventional signals and HDTV signals are in remote channels and in which said initial second antenna section is capable of being removed and said alternate second antenna section for said HDTV signals serves as a replacement for said initial second antenna section when removed.

2. A system as defined in claim 1, further in which said means for selectively coupling includes a junction box and lines connecting said junction box to said second antenna section.

3. A system as defined in claim 1, in which said first and second antenna sections are coupled in a stacked relationship.

4. A system as defined in claim 1, in which said second antenna section is shorter than said first antenna section.

5. A system as defined in claim 1, in which said first and second antenna sections include broad band radiators in groups of three at each of a plurality of bays.

6. A system as defined in claim 1, in which said second antenna section includes eight helically wound conductors fed in mode two for broadcasting the HDTV signals in the channel 7–13 VHF band.

7. A system as defined in claim 1, in which said second antenna section includes eight helically wound conductors fed in mode four for broadcasting the HDTV signals in the UHF band.

8. A system as defined in claim 1, in which said second antenna section includes an antenna having eight helically wound conductors operable in mode four broadcasting the HDTV signals in the UHF band.

9. A system as defined in claim 1, in which said second antenna section includes a center fed series of slots.

* * * * *